US011198488B2

(12) United States Patent
Smith

(10) Patent No.: US 11,198,488 B2
(45) Date of Patent: Dec. 14, 2021

(54) MOORING APPARATUS

(71) Applicant: Flintstone Technology Ltd, Dundee (GB)

(72) Inventor: David Smith, Dundee (GB)

(73) Assignee: FLINTSTONE TECHNOLOGY LTD., Dundee (GB)

( * ) Notice: Subject to any disclaimer, the term of this patent is extended or adjusted under 35 U.S.C. 154(b) by 0 days.

(21) Appl. No.: 16/606,745

(22) PCT Filed: Apr. 26, 2018

(86) PCT No.: PCT/GB2018/051103

§ 371 (c)(1),
(2) Date: Oct. 19, 2019

(87) PCT Pub. No.: WO2018/197882

PCT Pub. Date: Nov. 1, 2018

(65) Prior Publication Data

US 2020/0130782 A1 Apr. 30, 2020

(30) Foreign Application Priority Data

Apr. 27, 2017 (GB) ..... 1706743
Jul. 24, 2017 (GB) ..... 1711904

(51) Int. Cl.
*B63B 21/04* (2006.01)
*B63B 21/50* (2006.01)
*E02B 3/24* (2006.01)

(52) U.S. Cl.
CPC ..... *B63B 21/04* (2013.01); *B63B 21/50* (2013.01); *E02B 3/24* (2013.01)

(58) Field of Classification Search
CPC ..... B63B 21/00; B63B 21/04; B63B 21/50; B60D 1/00; B60D 1/155; A01K 87/00; E02B 3/24

(Continued)

(56) References Cited

U.S. PATENT DOCUMENTS 3,180,304 A 4/1965 Brady
4,193,368 A 3/1980 DeGraaf et al.

(Continued)

FOREIGN PATENT DOCUMENTS

GB 2512312 A 10/2014
WO 2009/141351 A 11/2009

OTHER PUBLICATIONS

International Search Report and Written Opinion of the International Searching Authority, International Application No. PCT/GB2018/051103, dated Jul. 27, 2018, 9 pp.

(Continued)

*Primary Examiner* — Lars A Olson
(74) *Attorney, Agent, or Firm* — Myers Bigel, P.A.

(57) ABSTRACT

A mooring apparatus (5*a;* 5*b;* 5*c;* 5*d*) comprising a socket (10*a;* 10*b;* 10*c;* 10*d*) having a seat (15*a,* 15*a'*; 15*b,* 15*b'*; 15*c,* 15*c'*; 15*d,* 15*d'*) and a connection member (20*a;* 20*b;* 20*c;* 20*d*), wherein the connection member (20*a;* 20*b;* 20*c;* 20*d*) is receivable, such as removably receivable, in the socket (10*a;* 10*b;* 10*c;* 10*d*) and rotatable on the seat (15*a,* 15*a'*; 15*b,* 15*b'*; 15*c,* 15*c'*; 15*d,* 15*d'*). A method of configuring a mooring apparatus (5*a;* 5*b;* 5*c;* 5*d*) wherein the method comprises providing a mooring apparatus (5*a;* 5*b;* 5*c;* 5*d*) and locating the connection member (20*a;* 20*b;* 20*c;* 20*d*) in the socket (10*a;* 10*b;* 10*c;* 10*d*) and/or on the seat (15*a,* 15*a'*; 15*b,* 15*b'*; 15*c,* 15*c'*; 15*d,* 15*d'*), and rotating the connection member (20*a;* 20*b;* 20*c;* 20*d*) until the connection member (20*a;* 20*b;* 20*c;* 20*d*) is retained by the socket (10*a;* 10*b;* 10*c;* 10*d*). A method of configuring a mooring apparatus (5*a;* 5*b;* 5*c;* 5*d*), wherein the method comprises providing a mooring apparatus (5*a;* 5*b;* 5*c;* 5*d*) and rotating the connection member (20*a;* 20*b;* 20*c;* 20*d*) until the connection member (20*a;* 20*b;* 20*c;* 20*d*) is not retained by the socket (10*a;* 10*b;* 10*c;* 10*d*) and moving the connection (Continued)

member (20*a;* 20*b;* 20*c;* 20*d*) from the seat (15*a,* 15*a';* 15*b,* 15*b';* 15*c,* 15*c';* 15*d,* 15*d'*).

14 Claims, 11 Drawing Sheets

(58) Field of Classification Search
USPC ..... 114/230.24, 230.26, 230.15
See application file for complete search history.

(56) References Cited

U.S. PATENT DOCUMENTS

| | | | | |
|---|---|---|---|---|
| 4,677,930 | A | 7/1987 | Ortloff | |
| 5,275,119 | A * | 1/1994 | Whitehead | B63B 21/20 114/230.24 |
| 5,293,831 | A | 3/1994 | Whitehead | |
| 6,908,260 | B2 * | 6/2005 | Beard | B63B 21/502 405/154.1 |
| 9,227,700 | B2 * | 1/2016 | Pontaut | B63B 21/04 |
| 10,005,522 | B2 * | 6/2018 | Taylor | B63B 21/50 |

OTHER PUBLICATIONS

International Preliminary Report on Patentability, International Application No. PCT/GB2018/051103, dated Oct. 29, 2019, 7 pp.

* cited by examiner

MOORING APPARATUS

RELATED APPLICATIONS

This application is a 35 U.S.C. § 371 national stage application of PCT Application No. PCT/GB2018/051103, filed on Apr. 26, 2018, which itself claims priority from Great Britain Patent Application No. 1711904.1, filed on Jul. 24, 2017, and Great Britain Patent Application No. 1706743.0, filed on Apr. 27, 2017, the contents of all of which are incorporated herein by reference in their entireties. The above-referenced PCT International Application was published in the English language as International Publication No. WO 2018/197882 A1 on Nov. 1, 2018.

FIELD OF INVENTION

This invention relates to an apparatus or device for connecting a mooring line, to a system for connecting a mooring line, and to a method of use of the apparatus, device or system for connecting a mooring line. The mooring line may be a mooring line for a vessel, an offshore structure, a buoyant structure, an anchor, a platform, a buoy or the like.

BACKGROUND TO INVENTION

Offshore structures, such as floating structures or platforms, may be moored by mooring lines, such as mooring chains. This may include attaching at least one mooring line to the structure to be moored and directly, or indirectly, coupling each mooring line to another structure, such as an anchor or pile located on the seabed.

A tension may be applied to each of the mooring lines, for example, by the use of a tensioning apparatus. The application of tension may serve to moor the floating structure or platform in desired position.

The mooring lines, and in particular the ends of the mooring lines, may comprise chains. A connection between a vessel, anchor, or the like, to a chain which may, in use, be under tension, may be prone to stress and wear.

In an offshore environment, because of relative movement between a vessel, a mooring line and an anchoring point, there may be a degree of movement at a connection between the mooring line and the vessel and/or anchoring point. Such movement may further stress and wear the mooring line and connection components. The relative movement may cause Out of Plane Bending (OPB) fatigue, which may exacerbate the wear of the mooring components.

The use of structures such as lever arms and fairleads, to minimise the effects of OPB, is known. However, such structures may be large, heavy, expensive and difficult to install, operate and/or maintain.

Further, the installation and maintenance of such structures in an offshore or underwater environment may require high levels of skill, the use of divers, operators, and/or underwater Remotely Operated Vehicles (ROVs), and may incur significant expense and risk.

It is an object of at least one embodiment of at least one aspect of the present invention to obviate or at least mitigate one or more problems in the prior art.

It is an object of at least one embodiment of at least one aspect of the present invention to provide a technically simple and/or commercially more cost effective apparatus and method for mooring than in the prior art.

SUMMARY OF INVENTION

According to a first aspect of the present invention there is provided a mooring apparatus. The mooring apparatus may comprise a socket. The socket may have a seat. The mooring apparatus may comprise a connection member. The connection member may be receivable (such as removably receivable) in the socket. The connection member may be rotatable on the seat.

The Applicant calls this apparatus a "Drop-In Uni-Joint".

The connection member may be for connecting, e.g. disconnectably connecting, to a mooring line.

The connection member may be rotatable around a first axis between a non-retained position and a retained position when received on a seat.

The connection member may be receivable in or removable from the socket when the connection member is disposed in a first orientation or non-retained position.

The connection member may be retained in the socket when the connection member is disposed in a second orientation or retained position.

The connection member may be adapted to rotate on the seat around the first axis defined by the at least one projection.

The connection member may comprise a joint defining a second axis about which at least a portion of the connection member may be adapted to rotate.

At least a portion of the connection member may be adapted to rotate around the first axis and the second axis.

The connection member may be provided with an arrangement for connecting the apparatus to a mooring line.

At least one seat may extend or protrude from at least one face of the socket and/or a plate.

By "rotatable", it is meant that the connection member is at least partially rotatable on the seat, such that the connection member may be rotated though a range of angles about an axis. The range of angles may be less than 360 degrees. The axis may be an axis that is substantially perpendicular to the socket or plate.

The at least one seat may be substantially hook-shaped.

The socket may comprise at least one guide portion.

The connection member may comprise at least one retaining member.

The connection member may be adapted for connecting the apparatus to a mooring line, or the like.

The connection member may comprises at least one projection, such as a trunnion, and optionally the connection member may comprise a pair of projections or trunnions which are receivable/retainable on the seat.

The at least one projection may be adapted to fit and/or sit in the at least one seat. The at least one projection may be adapted to fit and/or sit on an inner surface of the at least one seat.

The connection member and/or the retaining member may comprise at least one shoulder, wing or hook. The connection member or the retaining member may comprise a pair of shoulders, wings or hooks.

The at least one shoulder, wing or hook may be adapted to move around and/or rotate around or about an outer surface of the seat.

The connection member may be adapted to be located in a retained position within and/or by the socket.

In the retained position, the seat may be located between the at least one projection and the at least one shoulder, wing or hook.

The connection member may be adapted to be located in a non-retained position, i.e. a released position, within the socket. In the non-retained position the seat may be located such that the seat is not retained between the at least one projection and the at least one shoulder, wing or hook.

The apparatus may be adapted for connection to, or mounting on or in a structure. The structure may be a floating structure, a floating/buoyant structure, a vessel or the like. The structure may be an anchor, a pile (such as a suction pile), a gravity anchor, or the like.

In use, such as during installation and/or stowage and/or removal, replacement or maintenance of the apparatus, the at least a portion of the connection member may be at least partially submerged.

In use, such as during installation and/or stowage and/or removal, replacement or maintenance of the apparatus, the apparatus, or at least a portion of the apparatus, may be completely above a water line, completely below the water line, or at least partially submerged.

Advantageously, the present invention may require minimal/reduced diver or ROV interaction during installation. The use of divers and/or ROVs may add significant cost to installation operations. Further, in unfavourable weather/sea conditions, the use of divers and/or ROVs may incur risk.

Advantageously, the apparatus described above does not require implementation of a load bearing pin. Instead, in the present invention, a load may be carried by the at least one seat. Having a connection that does not require a load bearing pin may be advantageous for high load mooring lines as the Minimum Breaking Load (MBL) directly relates to the load pin size. Very large and heavy load pins may add more risk and potentially more cost to the installation.

Advantageously, the apparatus described above may be suitable for use on or at a vessel or floating structure and/or on at a top-loaded structure. That is, the apparatus may be mounted on a side of a vessel of floating structure in a substantially vertical orientation, or on a top of a structure, such as a pile, in a substantially horizontal orientation.

The connection member may be received in the socket with the connection member at a first angular disposition. The first angular disposition may, for example, be in a substantially vertical disposition relative to the socket. The first angular disposition may comprise a range of angles. In an exemplary embodiment, the first angular disposition may comprise a range of angles substantially between −45 degrees and +45 degrees from a vertical axis, or substantially between −20 degrees and +20 degrees from a vertical axis. In a further exemplary embodiment, the first angular disposition may comprise a range of angles substantially between 0 degrees and +45 degrees from a vertical axis, or between 0 degrees and +20 degrees from a vertical axis.

The connection member may be rotatable in the socket, about the axis, to a second angular disposition. When the connection member is in the second angular disposition, the connection member may be retained by the socket. The second angular disposition may comprise a range of angles. In an exemplary embodiment, the second angular disposition may comprise a range of angles substantially between 45 degrees and 180 degrees from a vertical axis, or substantially between 20 degrees and 180 degrees from a vertical axis.

According to a second aspect of the present invention there is provided a method of configuring a mooring apparatus, wherein the method comprises:

providing a mooring apparatus according to the first aspect of the present invention, the method further comprising:

locating the connection member in the socket and/or on the seat; and rotating the connection member until the connection member is retained by the socket.

According to a third aspect of the present invention there is provided a method of configuring a mooring apparatus, wherein the method comprises:

providing a mooring apparatus according to the first aspect of the present invention, the method further comprising:

rotating the connection member until the connection member is released by the socket; and moving the connection member from the seat.

According to a fourth aspect of the present invention there is provided a system for attaching a mooring line to a structure, the system comprising the mooring apparatus according to the first aspect.

The system may comprise a mooring line. At least a portion of the mooring line may comprise a chain.

The system may comprise a structure. The structure may be a subsea structure, such as an anchor, a suction pile, a gravity anchor, or the like. The structure may be located on or near to a seabed or floor of a body of water.

The structure may comprise at least one socket.

The mooring line may be connected to the connection member. The mooring line may be connected to a distal end of the connection member.

In use, the connection member may be lowered onto and or/into the socket by the mooring line. In use, the connection member may be lowered into the socket until the connection member engages with the seat.

In use, the connection member may be rotated within the socket until the connection member is in a retained position.

It should be understood that the features defined above in accordance with any aspect of the present invention or below relating to any specific embodiment of the invention may be utilised, either alone or in combination with any other defined feature, in any other aspect or embodiment or to form a further aspect or embodiment of the invention.

BRIEF DESCRIPTION OF DRAWINGS

These and other aspects of the present invention will now be described, by way of example only, with reference to the accompanying drawings, which are.

DETAILED DESCRIPTION OF DRAWINGS

Figure 1A:
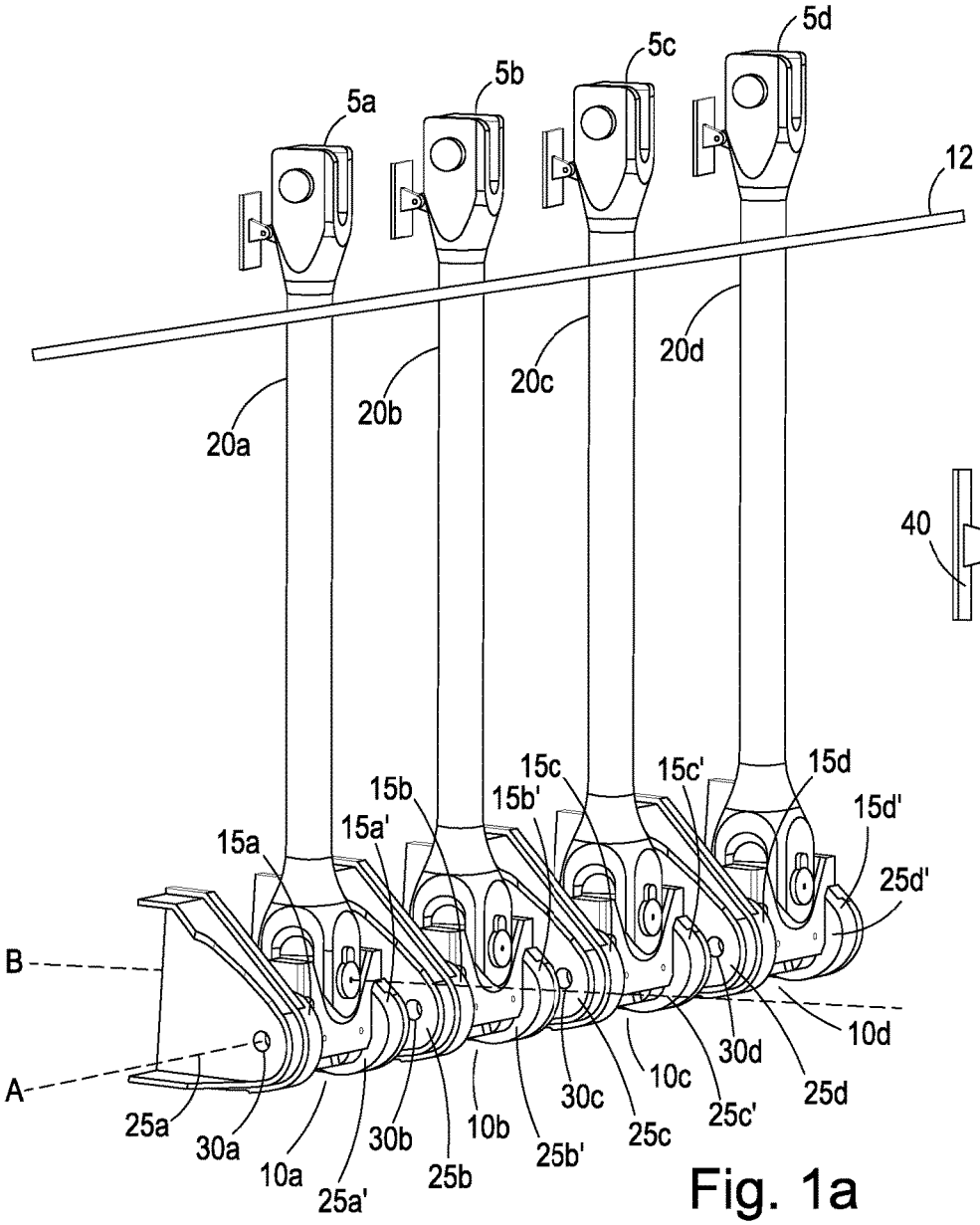
FIG. 1*a* a perspective view of a plurality of mooring apparatuses, each comprising a mooring apparatus according to a first embodiment of the present invention.

Referring firstly to FIGS. 1*a*, there is shown a perspective view of a plurality of mooring apparatuses 5*a*; 5*b*; 5*c*; 5*d*, according to a first embodiment of the present invention. As shown in FIG. 1*a*, each mooring apparatus 5*a*; 5*b*; 5*c*; 5*d* comprises a socket 10*a*; 10*b*; 10*c*; 10*d* having seats 15*a*, 15*a*'; 15*b*, 15*b*'; 15*c*, 15*c*'; 15*d*, 15*d*' and a connection member 20*a*; 20*b*; 20*c*; 20*d*. The connection member 20*a*; 20*b*; 20*c*; 20*d* is receivable within the socket 10*a*; 10*b*; 10*c*; 10*d* and retained and rotatable when on the seat 15*a*, 15*a*'; 15*b*, 15*b*'; 15*c*, 15*c*'; 15*d*, 15*d*'.

One will appreciate that in other embodiments encompassing the inventive concept of the present invention, the socket 10*a*; 10*b*; 10*c*; 10*d* may be a holder, a housing, a pocket, a receptacle, or the like.

The plurality of mooring apparatuses of FIG. 1*a* comprises a plurality of sockets 10*a*; 10*b*; 10*c*; 10*d*. Each socket 10*a*; 10*b*; 10*c*; 10*d* of the plurality of sockets is adapted to be adjacent to another socket 10*a*; 10*b*; 10*c*; 10*d* of the plurality of sockets. One will appreciate that in other embodiments encompassing the inventive concept of the present invention, each socket 10*a*; 10*b*; 10*c*; 10*d* of the plurality of sockets may be adapted to be affixed and/or connected to another socket of the plurality of sockets, either directly or indirectly. The plurality of sockets 10*a*; 10*b*; 10*c*; 10*d* are arranged in a row. Also, in the exemplary embodiment shown, there are four complete mooring apparatuses. One will appreciate that there may be fewer mooring apparatuses, such as one, two or three mooring apparatuses, or a greater number of mooring apparatuses, such as five or more.

Each socket 10*a*; 10*b*; 10*c*; 10*d* comprises at least one plate 25*a*, 25*a*'; 25*b*, 25*b*'; 25*c*, 25*c*'; 25*d*, 25*d*'. In the embodiment shown in FIG. 1*a*, each socket 10*a*; 10*b*; 10*c*; 10*d* comprises a pair of plates 25*a*, 25*a*'; 25*b*, 25*b*'; 25*c*, 25*c*'; 25*d*, 25*d*'.

Figure 6A:
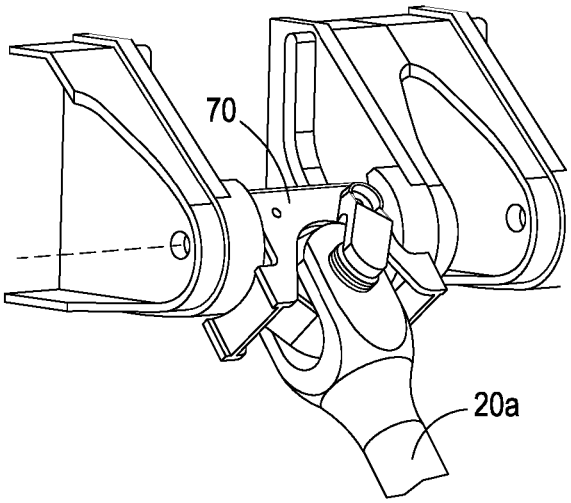
FIG. 6*a-e* a perspective view of a portion of the mooring apparatus according to FIG. 1.
Figure 6B:
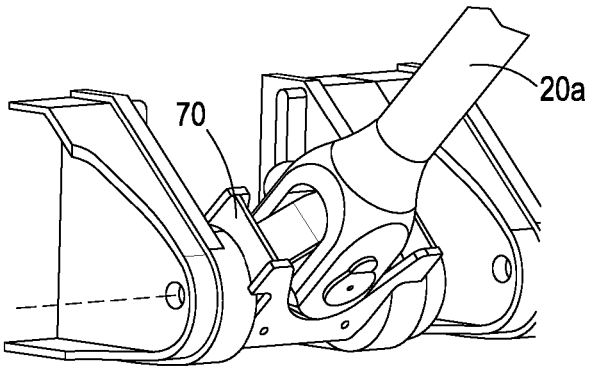
Figure 6C:
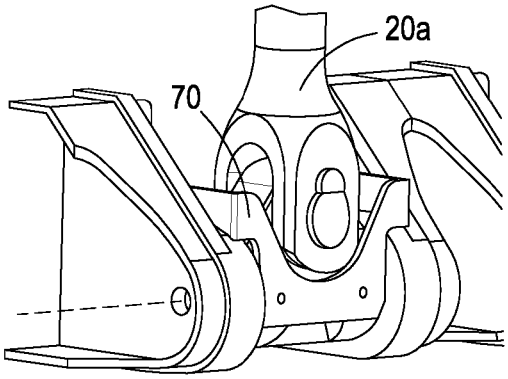
Figure 6D:
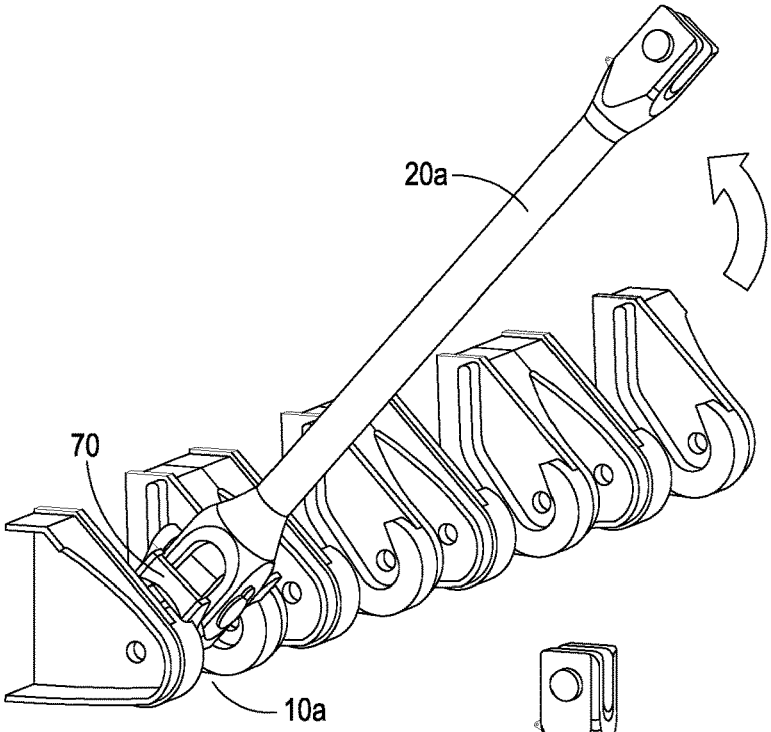
Figure 6E:
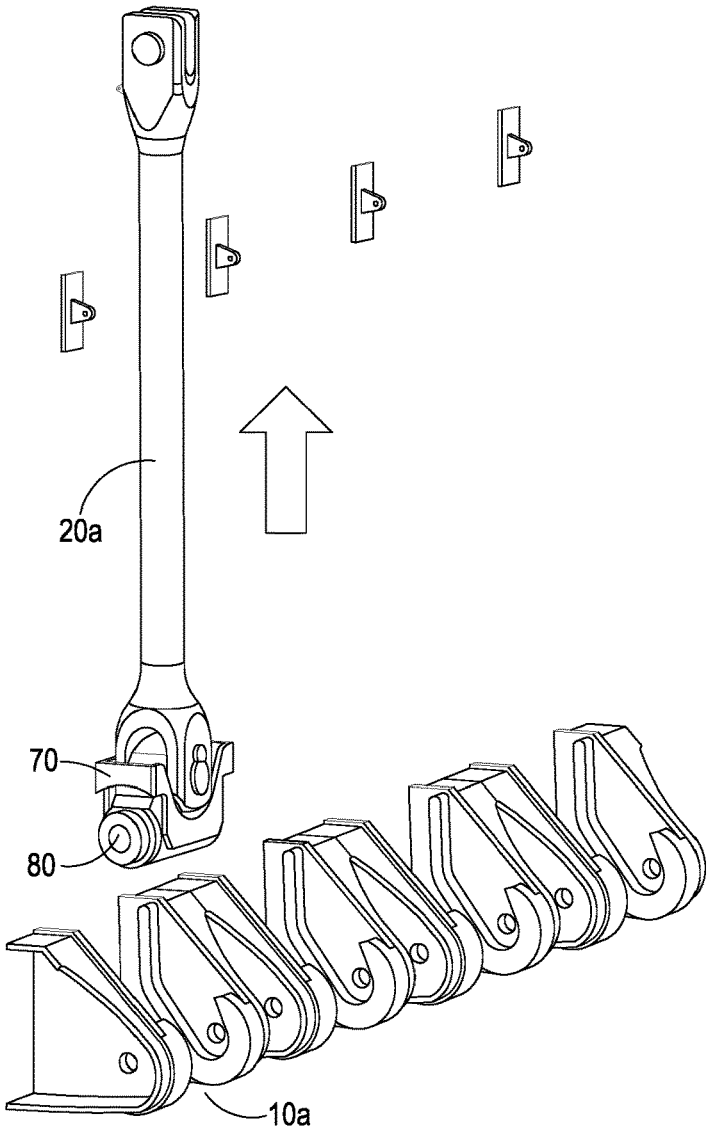

Each pair of plates 25*a*, 25*a*'; 25*b*, 25*b*'; 25*c*, 25*c*'; 25*d*, 25*d*' can be arranged symmetrically about an axis. Each pair of plates 25*a*, 25*a*'; 25*b*, 25*b*'; 25*c*, 25*c*'; 25*d*, 25*d*' is arranged to be complementary about the axis. Each plate 25*a*, 25*a*'; 25*b*, 25*b*'; 25*c*, 25*c*'; 25*d*, 25*d*' is a cheek plate. Each plate 25*a*, 25*a*'; 25*b*, 25*b*'; 25*c*, 25*c*'; 25*d*, 25*d*' comprises at least one hole 30*a*; 30*b*; 30*c*; 30*d*. In use, the at least one hole 30*a*; 30*b*; 30*c*; 30*d* is adapted to be in alignment with a corresponding hole 80 (see FIG. 6*e*) in the connection member 20*a*; 20*b*; 20*c*; 20*d*. As such, a pin 65 (see FIG. 3), axle, or other elongate element, can connect the connection member 20*a*; 20*b*; 20*c*; 20*d* to the plates 25*a*, 25*a*'; 25*b*, 25*b*'; 25*c*, 25*c*'; 25*d*, 25*d*'. Alternatively, the holes 30*a*; 30*b*; 30*c*; 30 can be adapted for use with tension monitoring equipment.

Figure 1B:
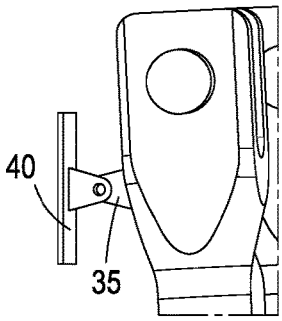
FIG. 1*b* a magnified view of a portion of the first embodiment of FIG. 1*a;*

As shown in FIG. 1*b*, the connection members 20*a*; 20*b*; 20*c*; 20*d* comprise a fastening device 35. The fastening device 35 is located at a distal end of the connection member 20*a*; 20*b*; 20*c*; 20*d*. One will appreciate that in other embodiments encompassing the inventive concept of the present invention, a different type of fastening can be implemented. For example, the fastening device 35 can be a sea fastening. In the exemplary embodiment shown, the fastening 35 is adapted to connect, or to be connected to or affixed, to a padeye 40. The fastening device 35 is adapted to fasten a distal end of the connection member 20*a*; 20*b*; 20*c*; 20*d* to a structure.

Figure 2:
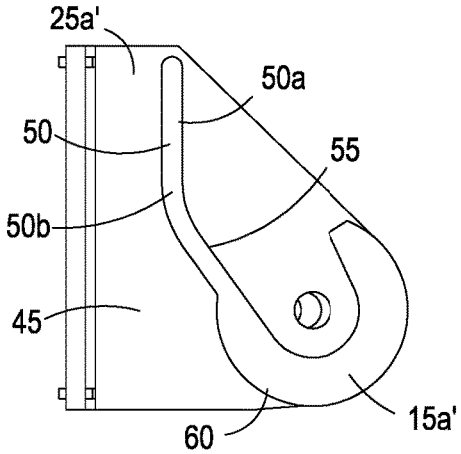
FIG. 2 a side view of a cheek plate according to the first embodiment of the present invention.

Referring now to FIG. 2, there is shown a side view of a plate 25*a*', according to the first embodiment of the present invention. The plate 25*a*' comprises the seat 15*a*'. The seat 15*a*' protrudes from one face 45 of the plate 25*a*'.

The seat 15*a*' is substantially hook-shaped. One will appreciate that in variations of a design that encompass the inventive concept of the present invention, the seat 15*a*' can be substantially J-shaped, or "reverse-J" shaped, or cup-shaped. The seat 15*a*' is a boss or protuberance.

Each socket 10*a*; 10*b*; 10*c*; 10*d* comprise at least one guide portion 50. The guide portion 50 extends from face 45 of the plate 25*a*' and/or each socket 10*a*, 10*b*, 10*c*, 10*d*. The guide portion 50 comprises a substantially linear portion 50*a* and a substantially curved portion 50*b*. The guide portion 50 extends to and connects with the at least one seat 15*a*'. The at least one guide portion 50 is a boss or protuberance.

An inner surface 55 of the at least one guide portion 50 is substantially smooth. An inner surface 55 of the seat 15*a*' is substantially smooth.

An outer surface 60 of the seat 15*a*' is substantially smooth. One will appreciate that an outer surface 60 of the at least one guide portion 50 is substantially smooth.

A portion 50*a* of the guide portion 50 extends substantially vertically away from the at least one seat 15*a*'. A portion 50*a* of the guide portion 50 inclines substantially vertically away from the seat 15*a*'.

Figure 5A:
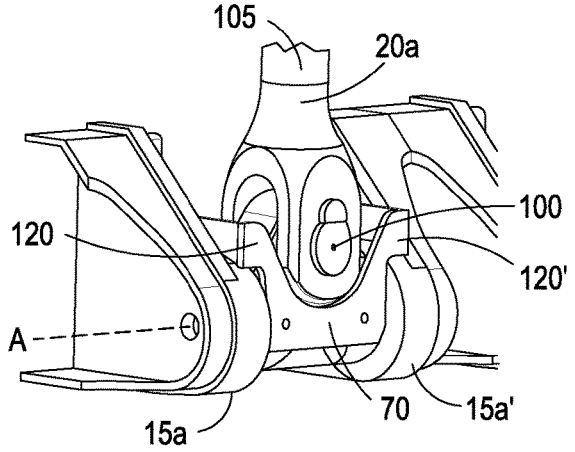
FIG. 5*a-c* a perspective view of a portion of the mooring apparatus according to FIG. 1.

Each connection member 20*a*, 20*b*, 20*c*, 20*d* comprises a retaining member 70 (see FIG. 5*a*). The retaining member 70 can be removably attached to the connection member 20*a*; 20*b*; 20*c*; 20*d*, as will be described in more detail below with reference to FIGS. 5*a* to 5.

Figure 3:
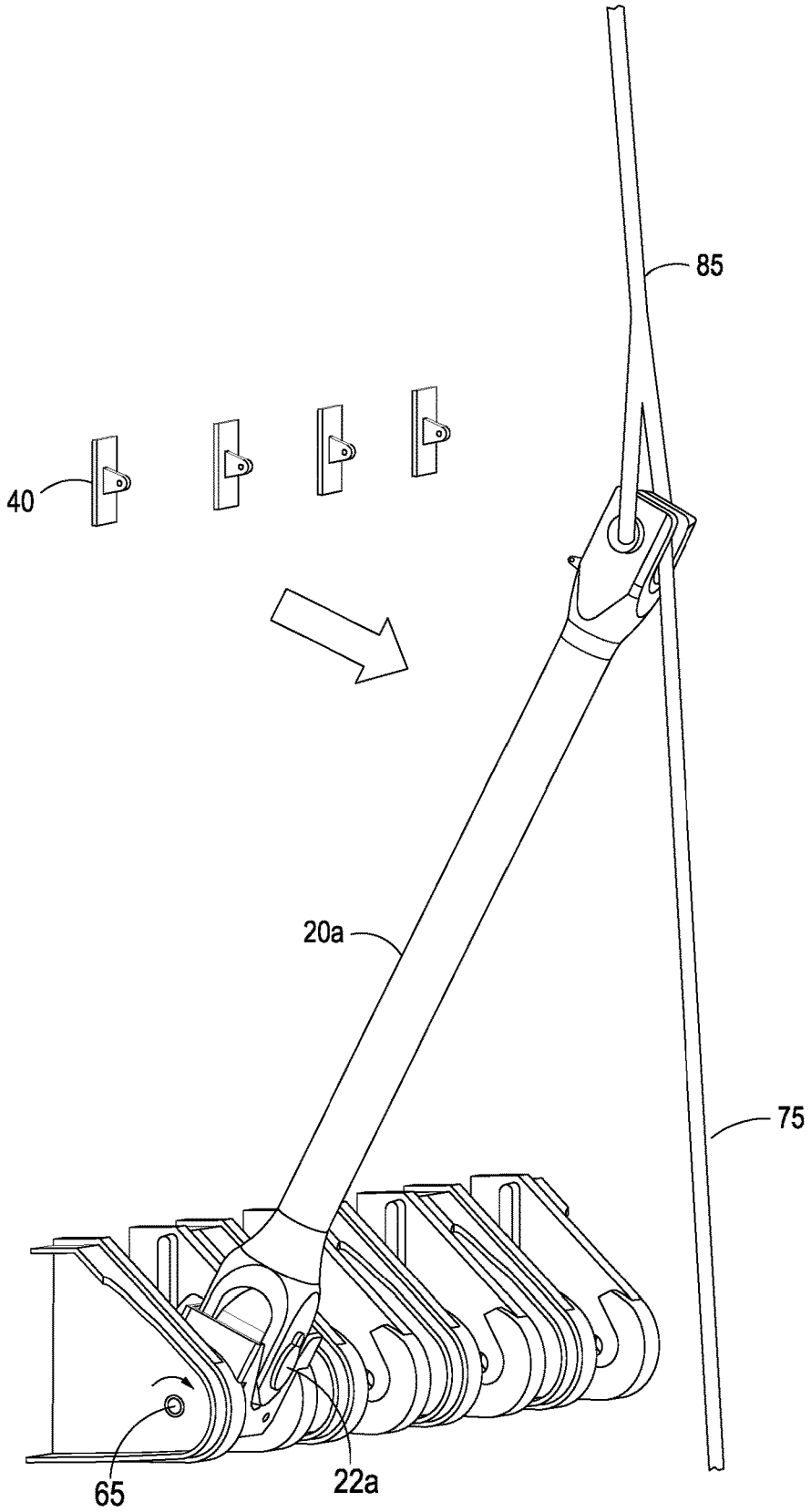
FIG. 3 a diagram showing a step in the installation process of the mooring apparatus according to the first embodiment of the present invention.

Referring now to FIG. 3, there is shown a diagram of a step in the installation process of the mooring apparatus 5 according to the first embodiment of the present invention. The connection member 20*a* is adapted for connecting the apparatus 5 to a mooring line 75. At least a portion of the mooring line 75 can be a mooring chain. The distal end of the connection member 20*a* is also adapted for connection to a lifting wire 85. One will appreciate that the lifting wire 85 can be a lifting line, a bridle, or the like. In an initial drop-in position, the lifting wire 85 holds the connection member 20*a* in a position such that the distal end of the connection member is substantially raised above a height of the socket 10*a*.

Figure 4A:
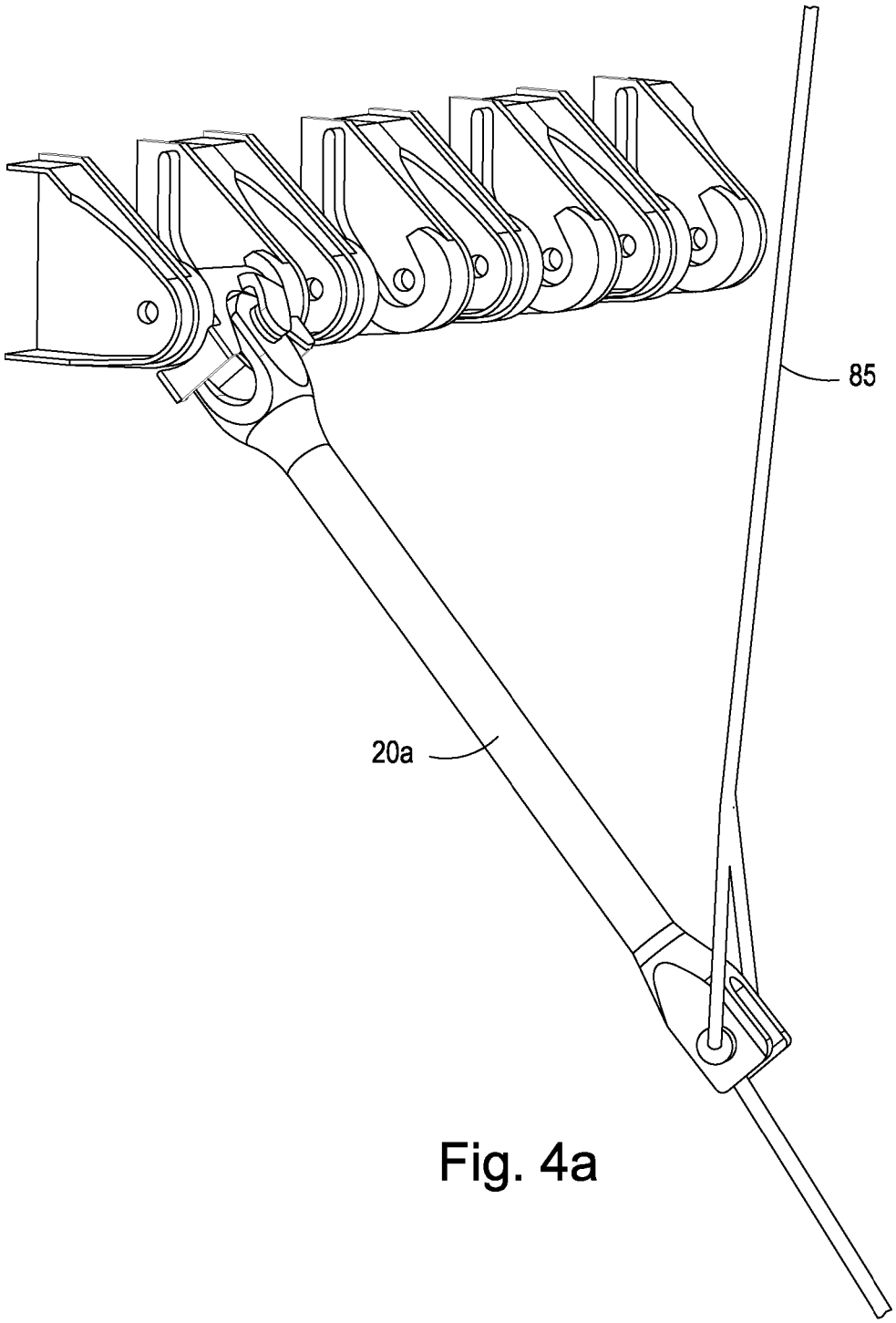
FIG. 4*a* a diagram showing a further step in the installation process of the mooring apparatus according to the first embodiment of the present invention.

Referring now to FIG. 4*a*, there is shown a further step in the installation process of the mooring apparatus 5 according to the first embodiment of the present invention. In a moored position, the lifting wire 85 holds the connection member 20*a* in a position such that the distal end of the connection member is substantially lowered below a height of the socket 10*a*. In this position the connection member 20*a* is retained in the socket 10*a*. The moored position is a retained position. The retained position will be described in more detail below with reference to FIGS. 5*a*, 5*b* and 5*c*.

Figure 4B:
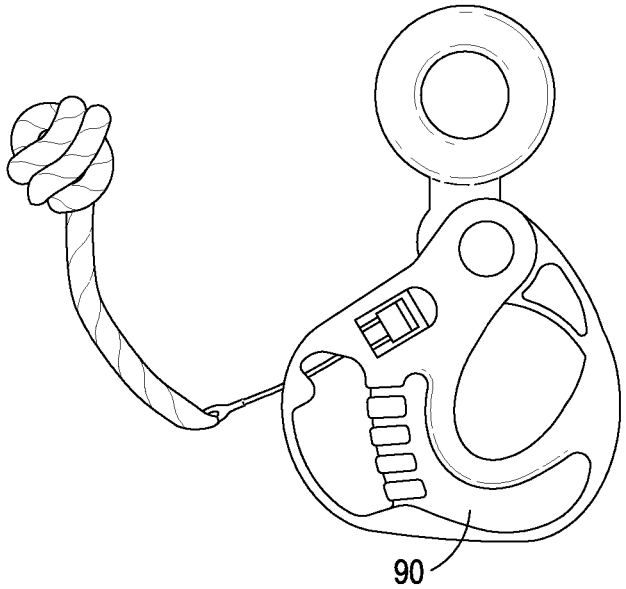
FIG. 4*b* an example of a remote hook release for use with the first embodiment of FIG. 4*a;*
Figure 4C:
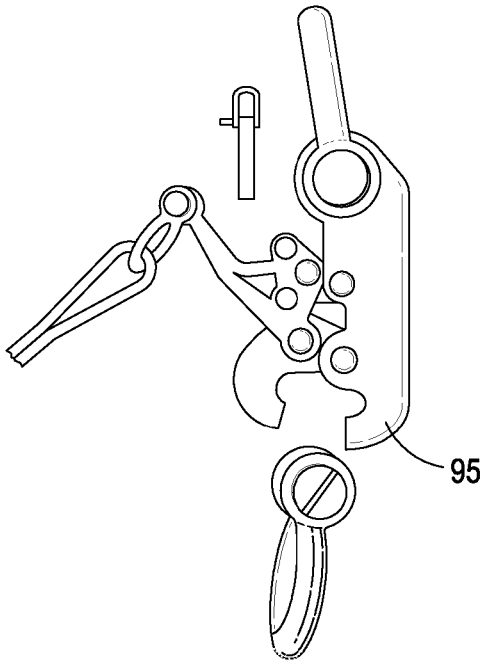
FIG. 4*c* a further example of a remote hook release for use with the first embodiment of FIG. 4*a;*

Once the connection member 20*a* is in the retained position, the lifting wire 85 can be removed. The lifting wire, a lifting line, a bridle, or the like, can be releasably attached to the connection member by means of a remote hook release 90, 95, as exemplified in FIGS. 4*b* and 4*c*. One will appreciate that, alternatively, the lifting wire 85 can be detached from the - connection member 10*a* by means of a ROV or by a diver.

Figure 5B:
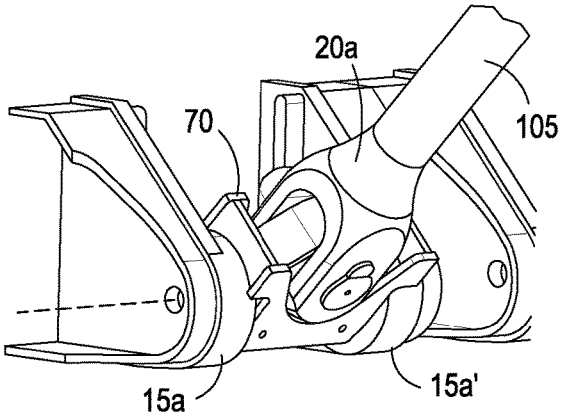
Figure 5C:
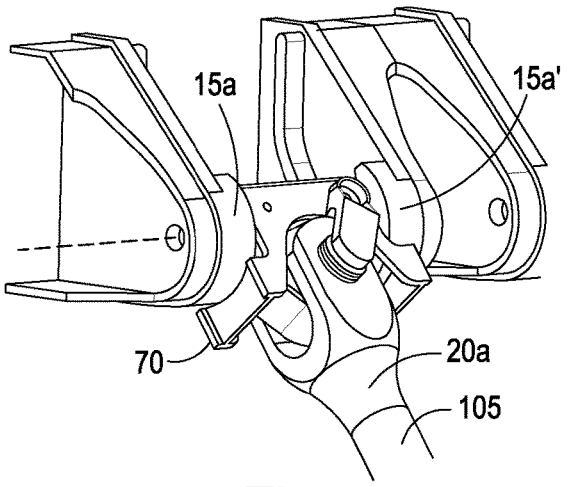
Figure 5D:
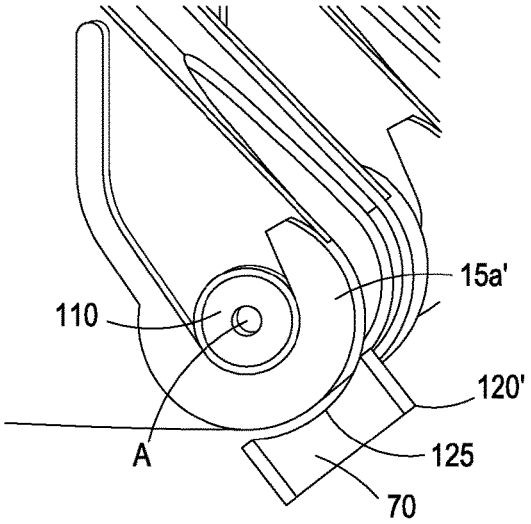
FIG. 5*d* a cross-sectional view of a portion of the mooring apparatus of FIG. 5*c;*

Referring now to FIGS. 5*a* to 5*c*, there is shown a series of perspective views of a portion of the mooring apparatus according to FIG. 1. The connection member 20*a* comprise a plurality of components. Each component of the plurality of components can be fixedly and/or releasably attached to the connection member 20*a*.

The connection member 20*a* comprises a universal joint 100. The universal joint 100 is located substantially at a proximal end of the connection member 20*a*. The connection member 20*a* comprises an elongate member, which in this embodiment is a lever arm 105. The connection member 20*a* is adapted to sit in the retaining member 70.

The connection member comprise at least one projection. In the embodiment of FIGS. 5*a-c*, and as more clearly shown in FIG. 5*d*, the projection is a trunnion 110. The connection member 20*a* comprises a pair of trunnions 110. The trunnions 110 are adapted to sit in the seats 15*a*, 15*a*'. The trunnions 110 are adapted to sit on an inner surface 55 of the seats 15*a*, 15*a*'. One will appreciate that a diameter of the trunnions 110 may be selected to be at least slightly smaller than an inner diameter of a curved portion of the seats 15*a*, 15*a*'. The trunnions 110 are substantially at a proximal end of the connection member 20*a*. The trunnions 110 are disposed substantially closer to the universal joint 100 than to the distal end of the connection member.

The connection member 20*a* is adapted to be rotated and/or pivoted within or about the seats 15*a*, 15*a*'. The connection member 20*a* is adapted to be rotated and or pivoted about a first axis A. The first axis A is defined by a centre point of a c-shaped portion of the seat 15*a*, 15*a'*.

The retaining member 70 comprises a pair of shoulders or wings 120, 120'. The pair of shoulders or wings 120, 120' are arranged at opposite sides of the connection member 20*a*. The pair of shoulders or wings 120, 120' are arranged symmetrically at opposite sides of the connection member 20*a*. One will appreciate that in other embodiments that encompass the inventive concept of the present invention, the retaining member 70 comprises a pair of hooks.

The pair of shoulders or wings 120, 120' is adapted to fit over and/or around the outer surface 60 of the seats 15*a*, 15*a*'. The pair of shoulders or wings 120, 120' comprise curved surfaces. The curved surfaces form a second seat 125 or yoke. The second seat 125 is adapted to fit over and/or around the seat 15*a'*.

The pair of shoulders or wings 120, 120' is adapted to move around and/or rotate/pivot around the outer surface of the seat 15*a*'. The second seat 125 is adapted to move around and/or rotate around an outer surface 60 of the seat.

The pair of shoulders or wings 120, 120' is located substantially at a proximal end of the connection member 20*a*. The connection member 20*a* is be adapted to be located in a retained position within the socket 10*a*. In the retained position, the trunnions 110 are located on, or in contact with, or immediately adjacent, the inner surface 55 of the seats 15*a*, 15*a*'. In the retained position, the pair of shoulders or wings 120, 120' is located on, or in contact with, or immediately adjacent, an outer surface 60 of the seats 15*a*, 15*a'*.

In the retained position shown in FIG. 5*c*, the seats 15*a*, 15*a*' are located between the trunnions 110 and the shoulders or wings 120, 120'. The connection member 20*a* is adapted to be rotatable about the first axis A when the connection member 20*a* is in the retained position.

In FIG. 5*a*, the connection member 20*a* is adapted to be moved to a non-retained position within the socket 10*a*. In the non-retained position, the at least one projection 120, 120' can be located on a surface of the seat 15*a*, 15*a*' or the guide portion 50. In the non-retained position, the pair of shoulders or wing 120, 120' cannot be in contact with, or immediately adjacent, an outer surface 60 of the seat 15*a*'. In the non-retained position the apparatus 5*a* is adapted such that the seat 15*a*' is not retained between the trunnions 110 and the pair of shoulders or wings 120, 120'.

Referring now to FIGS. 6*a* to 6*e*, there is shown a perspective view of a portion of a mooring apparatus 5*a*; 5*b*; 5*c*; 5*d* according to FIG. 1.

The connection member 20*a* can be transitioned from a first retained position to a second retained position, when the connection member 20*a* remains positioned within a limited range of angles relative to the socket 10*a*. The connection member 20*a* can be transitioned from a first retained position to a second retained position, when the connection member 20*a* remains positioned within a limited range of angles relative to a vertical axis.

One will appreciate that the exact angle at which a connection member 20*a* can be removed from the socket 10*a* or is retained by the socket 10*a* can be adjusted or tuned by changing an overlap between the retaining member 70 and the seat 15*a*'. That is, the dimensions of the overlap, and hence the extent of overlap, can be selected to determine a range of angles of the connection member 20*a* that allow the connection member 20*a* to be released from the socket 10*a* or retained by the socket 10*a*.

As can be seen in the exemplary embodiment of FIGS. 6*a* to 6*e*, the connection member 20*a* requires positioning at a substantially vertical position to enable insertion or removal of the connection member 20*a* into or from the socket 10*a*.

Figure 7A:
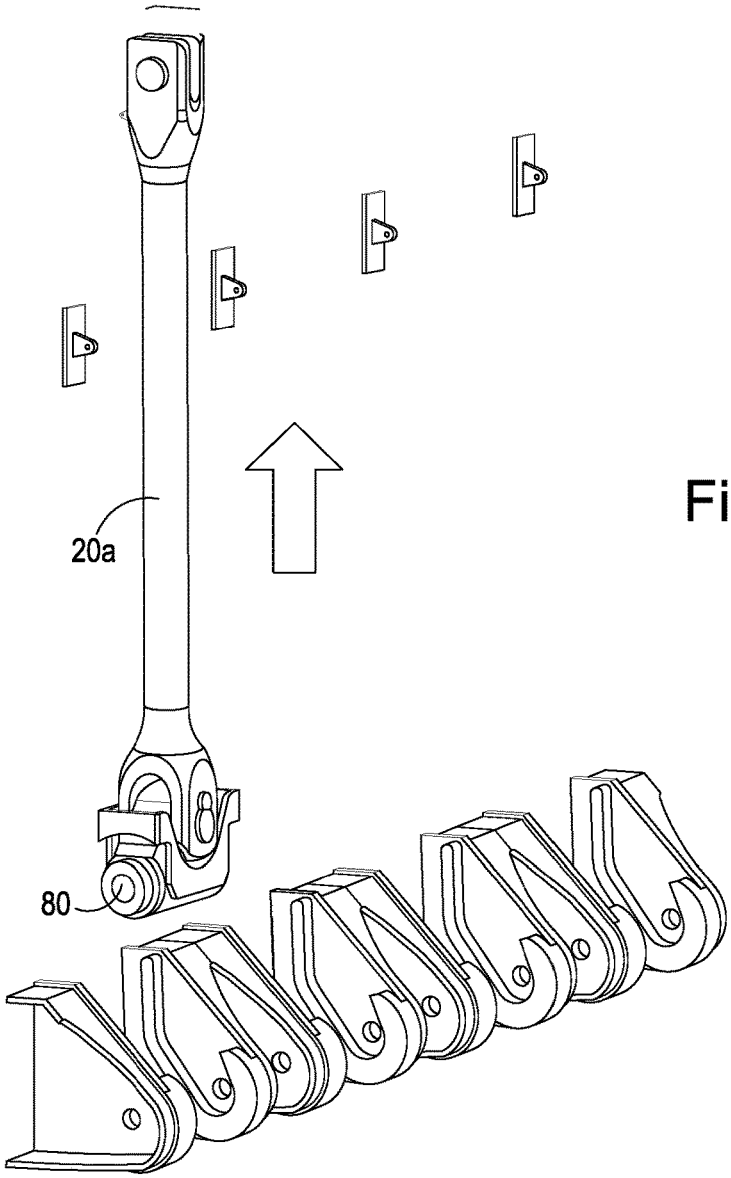
FIG. 7*a-b* a perspective view of a portion of the mooring apparatus according to FIG. 1.
Figure 7B:
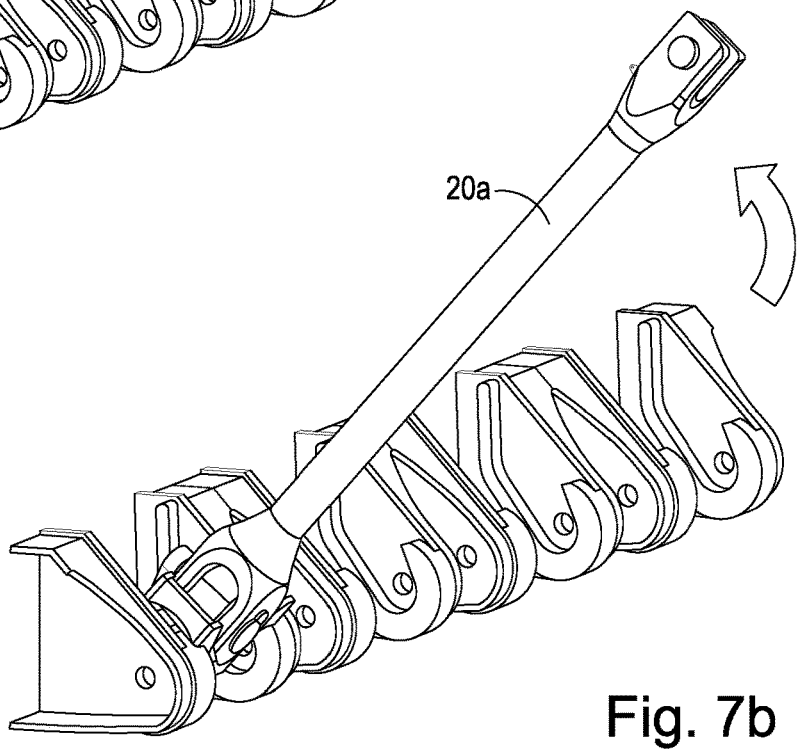

As shown in FIGS. 7*a* and 7*b*, the connection member 20*a* installation process is the reverse of the connection member 20*a* removal process.

Figure 8A:
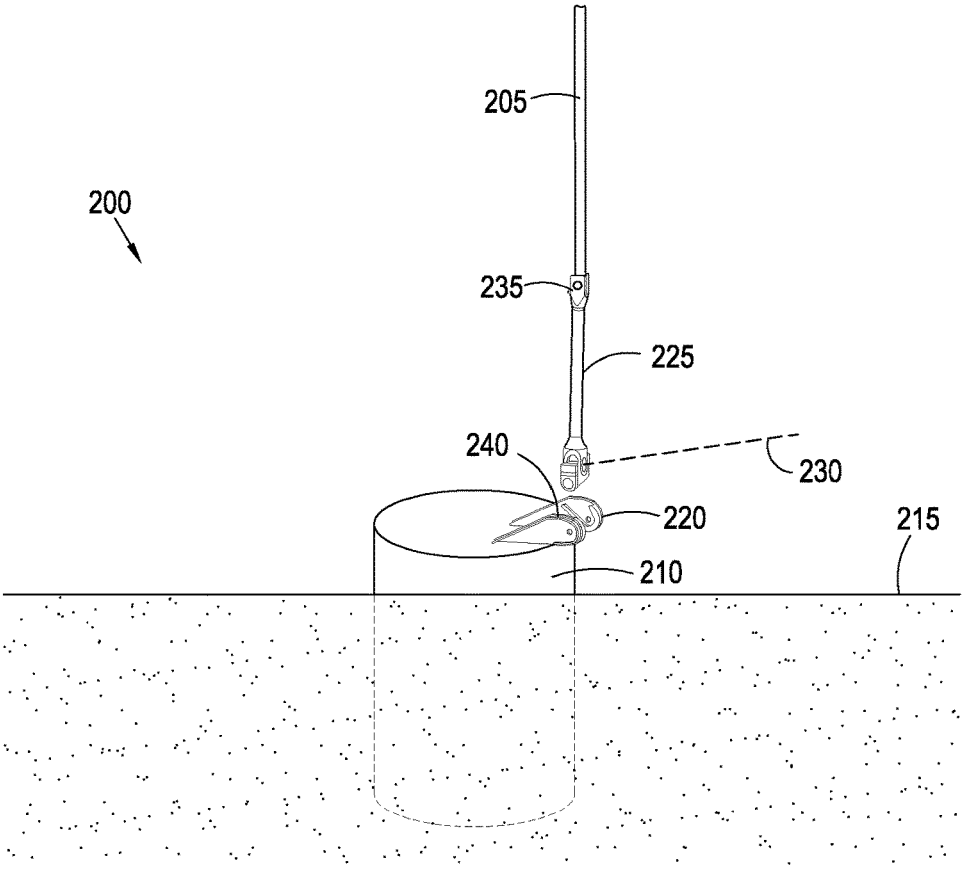
FIG. 8*a* a representation of a system for attaching a mooring line to a structure according to another embodiment of the present invention.
Figure 8B:
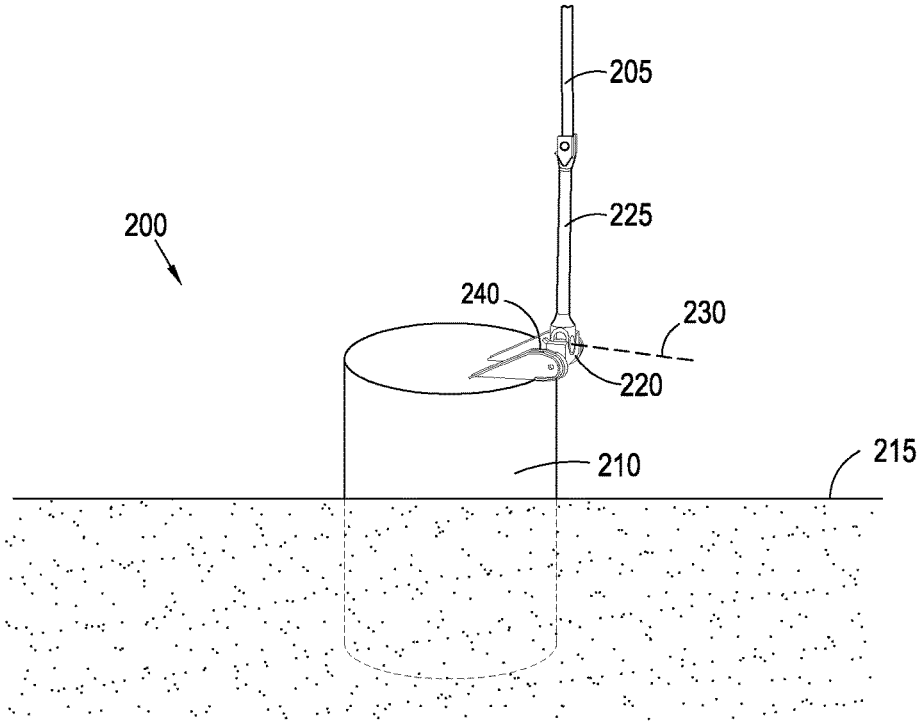
FIG. 8*b* a further representation of the system for attaching a mooring line to a structure of FIG. 8*a;*
Figure 8C:
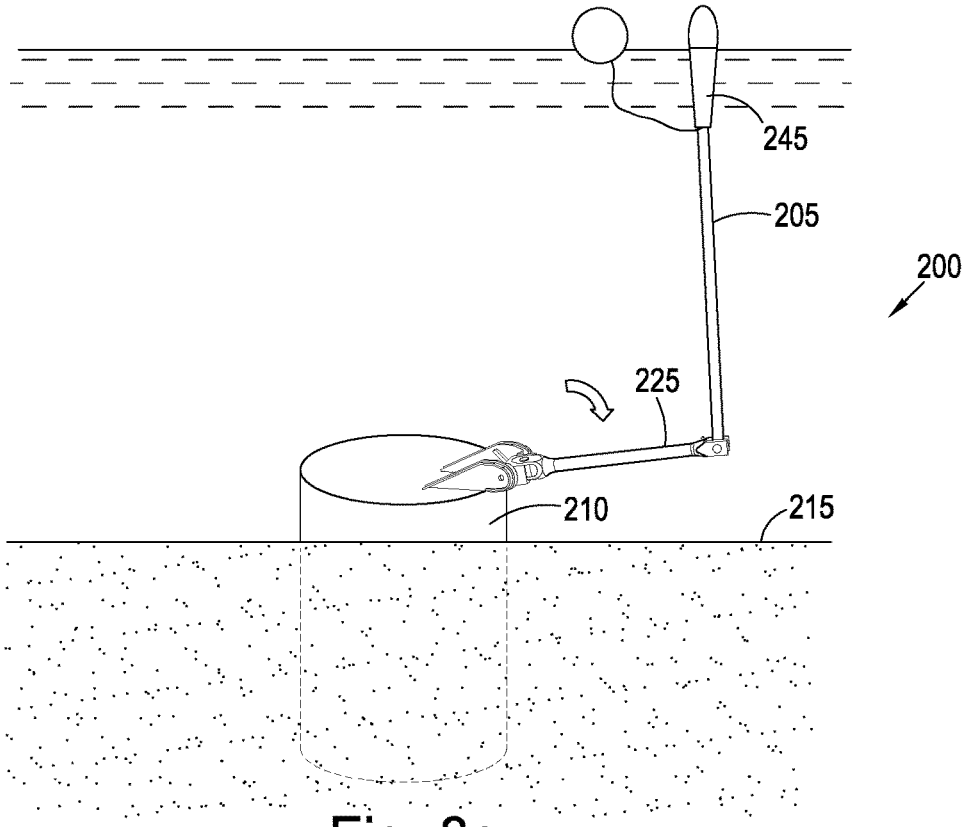
FIG. 8*c* a further representation of the system for attaching a mooring line to a structure of FIG. 8*a;*

FIGS. 8*a* to 8*c* shows a representation of a system, generally denoted 200, for attaching a mooring line to a structure 210 according to another embodiment of the present invention. FIG. 8*a* shows the system 200 comprising a mooring line chain tail 205. The system 200 comprises a structure 210. The structure 210 is a subsea structure. In the exemplary system shown, the structure 210 is a pile. One will appreciate that in other embodiments that encompass the inventive concept of the present invention, the structure can be an anchor, a suction pile, a gravity anchor, or the like. The structure 210 is located on a seabed 215 or floor of a body of water.

The structure 210 comprises a socket 220. The mooring line chain tail 205 is connected to the connection member 225. The mooring line chain tail 205 is connected to a distal end 235 of the connection member 225.

As shown in FIG. 8*b*, in use, the connection member 225 is lowered onto and into the socket 220 by the mooring line chain tail 205. An additional guide wire 230 can be used to position the connection member 225 relative to the socket 220. In use, the connection member 225 is lowered into the socket 220 until the connection member 225 engages with the seat 240.

Figure 8D:
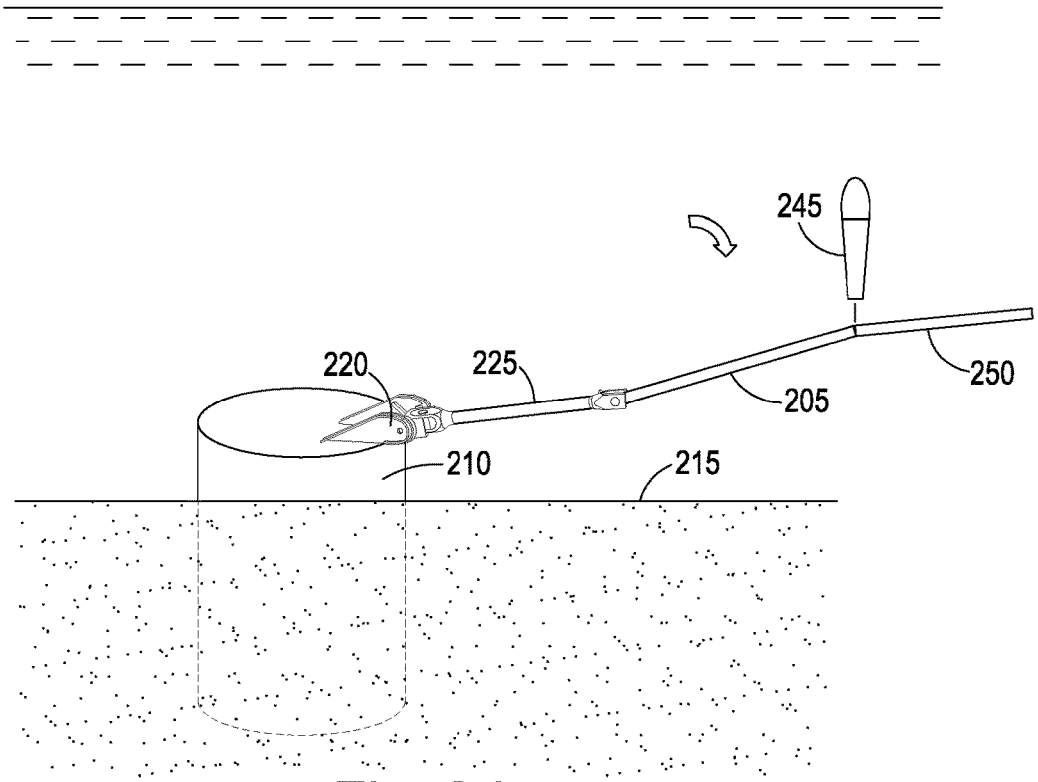
FIG. 8*d* a further representation of the system for attaching a mooring line to a structure of FIG. 8*a;*

As shown in FIG. 8*c*, in use, the connection member 225 is rotated within the socket 220 until the connection member 225 is in a retained position. In the embodiment shown in FIG. 8*c*, the distal end 235 of the connection member 225 remains connected to the chain tail 205, thus providing a configuration suitable for mooring. In FIG. 8*d*, the chain tail 205 is connected to a mooring line 250. A buoy 245 or other flotation device can be employed to hold an end or portion of the chain tail 205 in a position until a mooring line 250 is attached to the chain tail 205.

One will appreciate that in other embodiments that encompass the inventive concept of the present invention, the mooring line 250 can be connected directly to the connection member 225. As such, a chain tail 205 may not be implemented between the mooring line 250 and the connection member 225.

Figure 9:
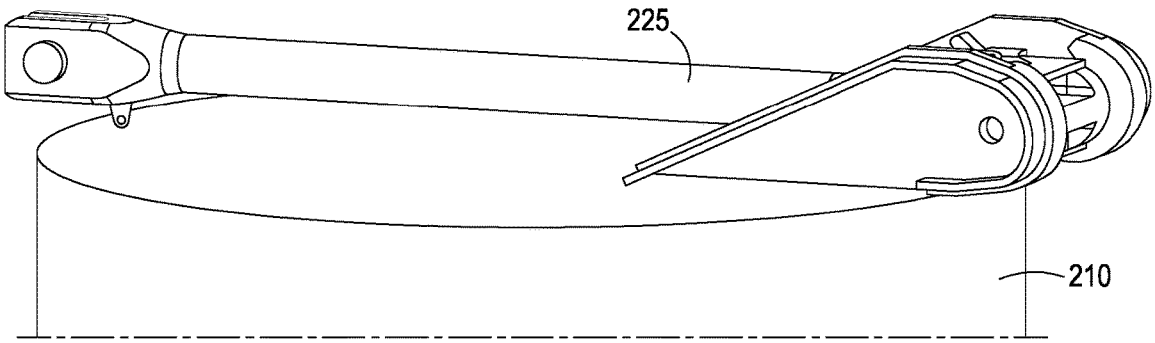
FIG. 9 a perspective view of a portion of a further embodiment of the system of FIG. 8*a*.

FIG. 9 shows a perspective view of a portion of a further embodiment of the system 200 of FIG. 8*a*. In this embodiment of a system for attaching a mooring line to a structure 210, the connection member 225 is inserted into the socket 220 before the structure 210 is located on or near to the seabed 215.

As shown in FIG. 8*a-d* and FIG. 9, the apparatus is adapted for connection to, or mounting on a structure. The structure can be an anchor, a pile, such as a suction pile, gravity anchor, or the like, as shown in FIGS. 8*a-d* and FIG. 9. However, one will appreciate that the structure can be a floating structure, a vessel or the like. Similarly, the structure can be buoy. The buoy can be a submersible buoy, a semisubmersible buoy, a submerged turret production buoy, a submerged turret loading buoy, or the like. In use, the apparatus can be at least partially submerged. In use, such as during installation and/or stowage and/or removal or replacement of the apparatus, the at least a portion of the connection member can above a water line 12, as shown in FIG. 1.

In the embodiments of the present invention shown in FIGS. 1 to 9, the apparatus comprises a universal joint 100. That is, the apparatus shown is a "Dual Axis" device. Specifically, the connection member 20*a* is rotatable on a pair of trunnions 110, about the first axis A defined by the trunnions 110. The connection member 20*a* is also rotatable about a second axis B the second axis B being substantially perpendicular to the first axis A, the second axis B, being centred on joint 22*a*. It will be appreciated that in other embodiments encompassing the inventive concept of the present invention, the connection member can be a "Single Axis" device, and may not comprise joint 22*a*. Such an arrangement would, for example, be adapted for use on a structure, wherein the structure has a rotatable portion, such as a turret mooring.

Advantageously, the system and apparatus shown in FIGS. 1 to 9 permits installation, removal, replacement or maintenance of the apparatus, with minimal diver or ROV interaction. In particular, in embodiments wherein several instances of the apparatus are clustered together, as shown in FIG. 1, the invention disclosed herein reduces a risk of diver or ROV entanglement or damage when accessing the apparatus, by reducing a need to directly accessing the sockets 10*a*; 10*b*; 10*c*; 10*d*.

A method of configuring a mooring apparatus 5*a*; 5*b*; 5*c*; 5*d*, and in particular of installing a mooring apparatus 5*a*; 5*b*; 5*c*; 5*d*, can comprise locating the connection member 20*a*, 20*b*, 20*c*, 20*d*, 225 on a guide portion 50. The method can comprise moving or sliding the connection member 20*a*, 20*b*, 20*c*, 20*d*, 225 on the guide portion 50. The method can comprise moving or sliding the connection member 20*a*; 20*b*; 20*c*; 20*d*; 225 on the guide portion 50 in a direction towards the seat 15*a*, 15*a*'; 15*b*, 15*b*'; 15*c*, 15*c*'; 15*d*, 15*d*'; 240. The method can comprise moving or sliding the connection member on the guide portion 50 until the connection member 20*a*; 20*b*; 20*c*; 20*d*; 225 is on the seat 15*a*, 15*a*'; 15*b*, 15*b*'; 15*c*, 15*c*'; 15*d*, 15*d*'; 240.

The method can comprise lowering the connection member 20*a*; 20*b*; 20*c*; 20*d*; 225 into the or each socket 10*a*; 10*b*; 10*c*; 10*d*.

The method can comprise lowering the connection member 20*a*; 20*b*; 20*c*; 20*d*; 225 into the or each socket 10*a*; 10*b*; 10*c*; 10*d* by means of a winch, a pulley, or the like.

A guide wire 85; 230 can be attached to the connection member 20*a*; 20*b*; 20*c*; 20*d*; 225. In use, a pulling force can be applied to the guide wire 85; 230 to steer the connection member 20*a*; 20*b*; 20*c*; 20*d*; 225 towards the or each socket 10*a*; 10*b*; 10*c*; 10*d*.

The method can comprise inserting a locking pin 65 into the or each socket 10*a*; 10*b*; 10*c*; 10*d* and/or the connection member 20*a*; 20*b*; 20*c*; 20*d*; 225. The method can comprise inserting a locking pin 65 into the or each socket and/or the connection member 20*a*; 20*b*; 20*c*; 20*d*; 225.

Figure 10:
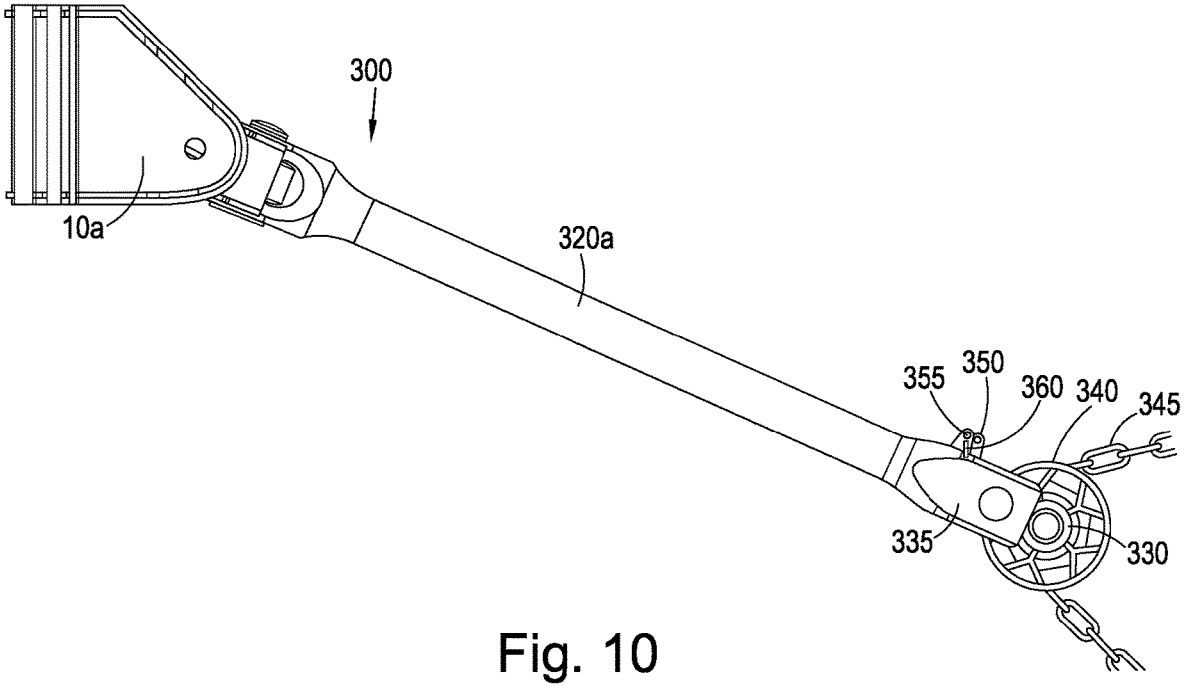
FIG. 10 a side view of yet a further embodiment of a mooring apparatus according to the present invention.

Referring now to FIG. 10, there is shown y a further embodiment of a mooring apparatus, generally denoted 300. The mooring apparatus 300 comprises the same socket 10*a* as the socket 10*a*; 10*b*; 10*c*; 10*d* of the embodiment shown in FIGS. 1*a* and 1*b*. In the exemplary embodiment shown in FIG. 10, there is a single mooring apparatus 300. One will appreciate that, in use, there can be more mooring apparatuses, such as two, three, four or even more mooring apparatuses, as shown, for example, in FIG. 1*a*.

The mooring apparatus 300 comprises a connection member 320*a*. The connection member 320*a* is receivable within socket 10*a*.

The connection member 320*a* comprises a tensioner apparatus 330. The tensioner apparatus 330 comprises a frame 335 and a guide portion 340 for guiding a portion of a chain 345. The guide portion 340 is a chain wheel. The tensioner apparatus 330 comprises a locking means 350. The locking means 350 is a chain stopper. The guide portion 340 is moveably connected to the frame 335. The locking means 350 is pivotably connected to the frame 335.

In an engaged position, as shown in FIG. 10, the locking means 350 restrains the guide portion 340 and/or the chain 345. The locking means 350 can be adapted to be locked in a disengaged position wherein the locking means 350 does not restrain the guide portion 340 and/or the chain 345. The tensioner apparatus 300 comprises a hole 355. A further locking pin 360 can be inserted in the hole 355, such that the further locking pin 360 engages with the locking means 350, thus retaining the locking means 350 in the disengaged position.

A method of configuring a mooring apparatus 5*a*; 5*b*; 5*c*; 5*d*, and in particular of removing or releasing a mooring apparatus 5*a*; 5*b*; 5*c*; 5*d*, can comprise moving or sliding the connection member 20*a*; 20*b*; 20*c*; 20*d* on the guide portion 50. The method can comprise moving or sliding the connection member 20*a*; 20*b*; 20*c*; 20*d* on the guide portion 50 in a direction away from the seat 15*a*, 15*a*'; 15*b*, 15*b*'; 15*c*, 15*c*'; 15*d*, 15*d*'.

It will be appreciated that the embodiments of the present invention herebefore described are given by way of example only and are not meant to limit the scope of thereof in any way. It will be appreciated that embodiments of the present invention provide benefits over the prior art.

The invention claimed is:

1. A mooring apparatus, comprising:

a socket having a pair of seats; and a connection member comprising at least one wing and provided with an arrangement for connecting the apparatus to a mooring line, wherein the connection member is removably receivable in the socket and rotatable on the pair of seats, the connection member is rotatable around a first axis between a non-retained position and a retained position when received on the pair of seats, the connection member comprises a pair of trunnions which are receivable/retainable on the pair of seats, and each trunnion is adapted to sit on an inner surface of a respective seat of the pair of seats, wherein in the retained position, at least a portion of the pair of seats is located between the pair of trunnions and the at least one wing, and in the non-retained position the pair of seats is not located between the pair of trunnions and the at least one wing.

2. The mooring apparatus as claimed in claim 1, wherein:

the connection member is receivable in or removable from the socket when the connection member is disposed in a first orientation or a non-retained position; and the connection member is retained in the socket when the connection member is disposed in a second orientation or the retained position.

3. The mooring apparatus as claimed in claim 1, wherein the first axis is defined by the pair of trunnions.

4. The mooring apparatus as claimed in claim 1, wherein the connection member comprises a joint defining a second axis about which at least a portion of the connection member is adapted to rotate.

5. The mooring apparatus as claimed in claim 1, wherein each seat of the pair of seats is substantially hook-shaped or J-shaped.

6. The mooring apparatus as claimed in claim 1, wherein the connection member comprises a pair of wings.

7. The mooring apparatus as claimed in claim 1, wherein the at least one wing is adapted to move around and/or rotate around or about outer surfaces of the pair of seats.

8. The mooring apparatus as claimed in claim 1, wherein at least one of:

the apparatus is adapted for connection to, and/or mounting on or in one of a floating structure, an offshore structure, a vessel, or an anchor; in use during installation and/or stowage and/or removal, replacement or maintenance of the apparatus, the at least a portion of the connection member is at least partially submerged.

9. A method of configuring a mooring apparatus, wherein the method comprises:

providing a mooring apparatus according to claim 1, the method further comprising:

locating the connection member in the socket and/or on the pair of seats; and rotating the connection member until the connection member is retained by the or each socket.

10. A method of configuring a mooring apparatus, wherein the method comprises:

providing a mooring apparatus according to claim 1, the method further comprising:

rotating the connection member until the connection member is not retained by the socket; and moving the connection member from the pair of seats.

11. A system for attaching a mooring line to a structure, the system comprising a mooring apparatus according to claim 1, wherein, in use, the connection member is lowered onto and or/into the socket by the mooring line until the connection member engages with the seat and the connection member is rotated within the socket until the connection member is in the retained position.

12. The system for attaching a mooring line to a structure as claimed in claim 11, wherein the system comprises the mooring line and optionally wherein: at least a portion of the mooring line comprises a chain and/or the mooring line is connected to the connection member.

13. The system for attaching a mooring line to a structure as claimed in claim 11, wherein the system comprises a subsea structure, or an anchor, and optionally wherein the structure comprises at least one socket.

14. The mooring apparatus as claimed in claim 1, wherein at least one of:

a distal end of the connection member is adapted for connection to a lifting wire; and/or the apparatus comprises a fastening device located at a distal end of the connection member.

* * * * *